US006039869A

United States Patent [19]

Dudley

[11] Patent Number: 6,039,869

[45] Date of Patent: Mar. 21, 2000

[54] SUPPORT ARRANGEMENT FOR CENTRIFUGAL CHIP SEPARATOR

[76] Inventor: Russell D. Dudley, 10215 Cricklewood Ct., Portage, Mich. 49024

[21] Appl. No.: 09/161,901

[22] Filed: Sep. 28, 1998

[51] Int. Cl.[7] ..... B04B 1/00

[52] U.S. Cl. ..... 210/232; 210/373; 210/380.1; 494/36

[58] Field of Search ..... 210/232, 360.1, 210/372, 364, 373, 380.1, 380.2, 781, 377; 494/36, 37, 43, 50, 60, 74, 79, 82

[56] References Cited

U.S. PATENT DOCUMENTS

| | | |
|---|---|---|
| 147,760 | 2/1874 | Frank et al. . |
| 198,346 | 12/1877 | Cairns . |
| 288,129 | 11/1883 | Shorey . |
| 305,026 | 9/1884 | Stillman . |
| 399,111 | 3/1889 | Adams et al. . |
| 408,791 | 8/1889 | Cairns . |
| 695,158 | 3/1902 | Lafferty . |
| 714,561 | 11/1902 | Cline . |
| 940,662 | 11/1909 | Bartholomew . |
| 986,635 | 3/1911 | Kirk . |
| 1,174,955 | 3/1916 | Balzer . |
| 1,554,299 | 9/1925 | Seibel . |
| 1,567,768 | 12/1925 | Sumbling . |
| 1,735,523 | 11/1929 | Barrett . |
| 1,764,909 | 6/1930 | Terwilliger . |
| 2,093,930 | 9/1937 | Rosenzweig . |
| 2,665,007 | 1/1954 | Hallander . |
| 3,366,318 | 1/1968 | Steimel . |
| 4,079,882 | 3/1978 | Mizuyoshi et al. . |
| 4,186,096 | 1/1980 | Areaux et al. . |
| 4,936,822 | 6/1990 | Nemedi . |

OTHER PUBLICATIONS

Exhibit A discloses a spec sheet for centrifuge equipment manufactured by Barrett Centrifugals, publication date unknown.

*Primary Examiner*—David A. Reifsnyder
*Attorney, Agent, or Firm*—Price Heneveld Cooper Dewitt & Litton

[57] ABSTRACT

A centrifugal chip separator includes a base having a raised platform and a centrifuge device with a centrifuge support plate located below the raised platform. A mount supports the centrifuge support plate on the base for multi-axial movement. A plurality of adjustable biasing devices is extended between the centrifuge support plate and the raised platform for adjustably biasing the centrifuge support plate against the mount. The biasing devices are easily and readily accessible outside of the chip separator, so that they can be adjusted to an optimal pressure for counteracting non-axial forces and vibrations generated, even while the centrifuge device is running. Also, the area under the centrifuge support plate and around the mount is characteristically open and unobstructed, such that inspection, repair, and maintenance is greatly facilitated. Still further, the arrangement allows use of lifters to raise the centrifuge support plate to separate the mount for repair, without maintenance personnel having to work in the mess and debris around the mount to disconnect the mount. Methods related to the above are also disclosed and claimed.

21 Claims, 3 Drawing Sheets

SUPPORT ARRANGEMENT FOR CENTRIFUGAL CHIP SEPARATOR

BACKGROUND OF THE INVENTION

The present invention concerns a centrifugal chip separator having an improved support arrangement that facilitates adjustment, maintenance, and repair of the chip separator, and in particular that facilitates repair and maintenance of a mount supporting the centrifuge device of the centrifugal chip separator. The improved support arrangement further promotes maintenance by providing a cleaner and more open environment in and around a bottom of the separator.

Centrifuge devices for continuously removing liquid from metal chips or other such scrap material are known in prior art. For example, see U.S. Pat. Nos. 3,366,318; 4,186,096; and 4,936,822. The above three patents support their rotating components on a flexible mount permitting multi-axial movement, but which operate to counter the effects of vibrations and other unbalanced forces generated by the rotating components of the centrifuge device. In some instances, the flexible mount has a ball-and-socket arrangement, while others use a series of elastomeric rings compressed so as to provide a similar effect as a ball-and-socket type mount. In each construction, adjustable biasing devices are provided inside the centrifuge housing that are adjustable to change the pressure on the pivot mount to optimize the effectiveness of the biasing devices. This can be problematic because the mechanic adjusting the biasing devices must come into close contact with the high speed rotating components of the centrifuge device.

Further, maintenance on the cited devices is extremely difficult and messy because it requires that the mechanic enter or reach inside of the centrifuge housing. Housings are normally very dirty, since they are covered with oil, cutting fluids, and residue from the centrifuging process. Not only is the environment unpleasant and dangerous, it is also very confined, dark, slippery, and difficult to work within.

Therefore, an apparatus solving the aforementioned problems and having the aforementioned advantages is desired.

SUMMARY OF THE PRESENT INVENTION

In one aspect of the present invention, a centrifugal separator includes a base having a bottom and a raised platform, and further includes a centrifuge device adapted to separate liquid from liquid-laden metal scrap by centrifugal force. The centrifuge device includes a centrifuge support plate located below the raised platform but above the bottom. A mount operably supports the centrifuge support plate on the bottom for limited non-axial movement as the centrifuge device is operated. A plurality of biasing devices extends between the centrifuge support plate and the raised platform. The biasing devices press against the raised platform to bias the centrifuge support plate downwardly away from the raised platform and against the mount. The biasing devices are spaced apart at locations around the mount and are adjustable, so that the biasing devices can be adjusted to an optimal pressure for counteracting non-axial forces and vibrations generated as the centrifuge device is operated.

In another aspect, a centrifugal separator includes a base having a bottom and a raised platform, and further includes a centrifuge device adapted to separate liquid from liquid-laden metal scrap by centrifugal force. The centrifuge device includes a centrifuge support plate located below the raised platform but above the bottom. A mount operably supports the centrifuge support plate on the bottom for limited non-axial movement as the centrifuge device is operated. A plurality of biasing devices is located between the centrifuge support plate and the raised platform. The biasing devices are spaced apart at locations around the mount and being adjustable, so that the biasing devices can be adjusted to an optimal pressure for counteracting non-axial forces and vibrations generated as the centrifuge device is operated. A plurality of lifters extends between the centrifuge support plate and the raised platform and is constructed to lift the centrifuge support plate off of the mount for repair and maintenance.

In another aspect, a centrifugal separator includes a base, and a centrifuge device adapted to separate liquid from liquid-laden metal scrap by centrifugal force, where the centrifuge device includes a centrifuge support plate. A mount operably supports the centrifuge support plate on the base for limited non-axial movement as the centrifuge device is operated. The mount includes a socket-defining member, and further includes a ball-section member operably engaging the socket-defining member. The socket-defining member comprises a pair of mating socket sections constructed to be mated together to form a socket for operably vertically receiving the ball-section member and constructed to be separated to facilitate removing the ball-section member from a lateral direction for repair and maintenance. A plurality of biasing devices is located between the centrifuge support plate and the raised platform. The biasing devices are space apart at locations around the mount and are adjustable, so that the biasing devices can be adjusted to an optimal pressure for counteracting non-uniform forces and vibrations generated as the centrifuge device is operated.

In yet another aspect, a method of the present invention includes a step of providing a centrifuge chip separator including a base having a raised platform, a centrifuge device having a centrifuge support plate located below the raised platform, a mount supporting the centrifuge support plate on the base, and biasing devices spaced around the mount for adjustably biasing the centrifuge support plate against the mount. The method further includes adjusting a tension of the biasing devices while operating the centrifuge device.

In another aspect, a method includes a step of providing a centrifuge chip separator including a base having a raised platform, a centrifuge device having a centrifuge support plate located below the raised platform, a mount supporting the centrifuge support plate on the base, and biasing devices spaced around the mount for adjustably biasing the centrifuge support plate against the mount. The method further includes providing lifters adapted to lift the centrifuge device including the centrifuge support plate, lifting the centrifuge support plate by extending the lifters through the raised platform into operative engagement with the centrifuge support plate, so that the lifters can be operated to lift the centrifuge support plate in a manner disassembling the mount and repairing at least part of the mount.

These and other features, objects, and advantages of the present invention will become apparent to a person of ordinary skill upon reading the following description and claims together with reference to the accompanying drawings.

DETAILED DESCRIPTION OF PREFERRED EMBODIMENT

Figure 1:
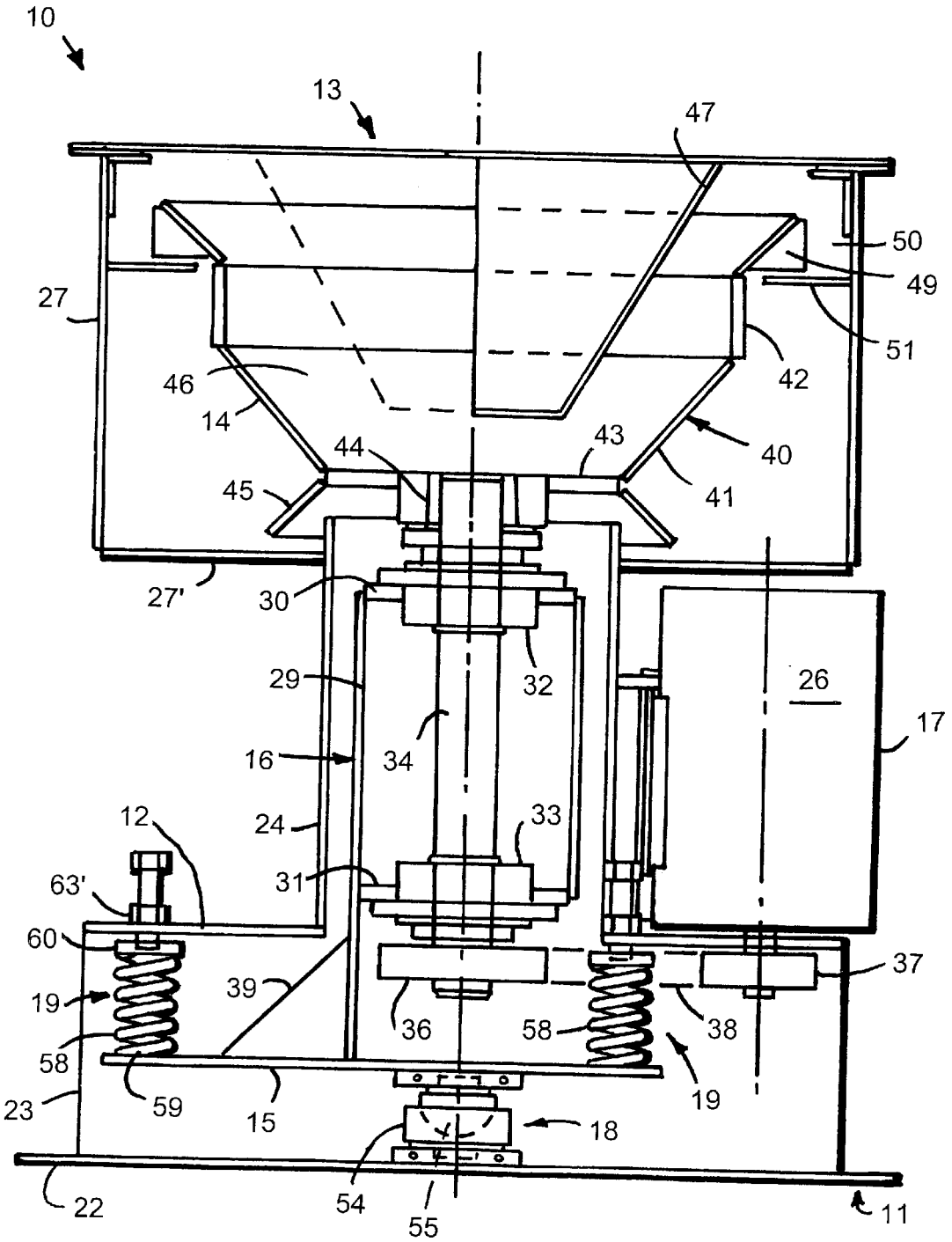
FIG. 1 is a side cross-sectional view of a centrifugal chip separator embodying the present invention.

A centrifugal chip separator 10 (FIG. 1) includes a base 11 having a raised platform 12. A centrifuge device 13 includes a centrifugal bowl 14 for separating coolant and cutting fluid from metal chips, and further includes a centrifuge support plate 15 that supports the centrifuge device 13 via stand 16. A drive mechanism 17 is operably mounted on the stand 16. A mount 18 operably supports the centrifuge support plate 15 on a bottom of the base 11 for limited non-axial movement as the centrifuge device 13 is operated.

Figure 4:
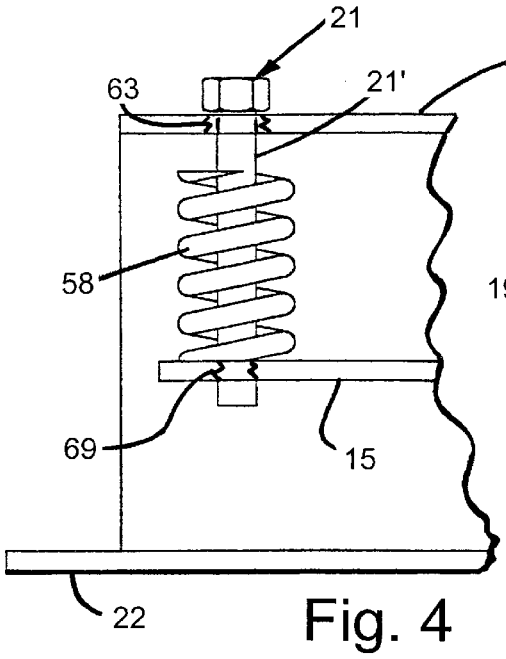
FIG. 4 is an enlarged view of the circled area IV in FIG. 3.
Figure 3:
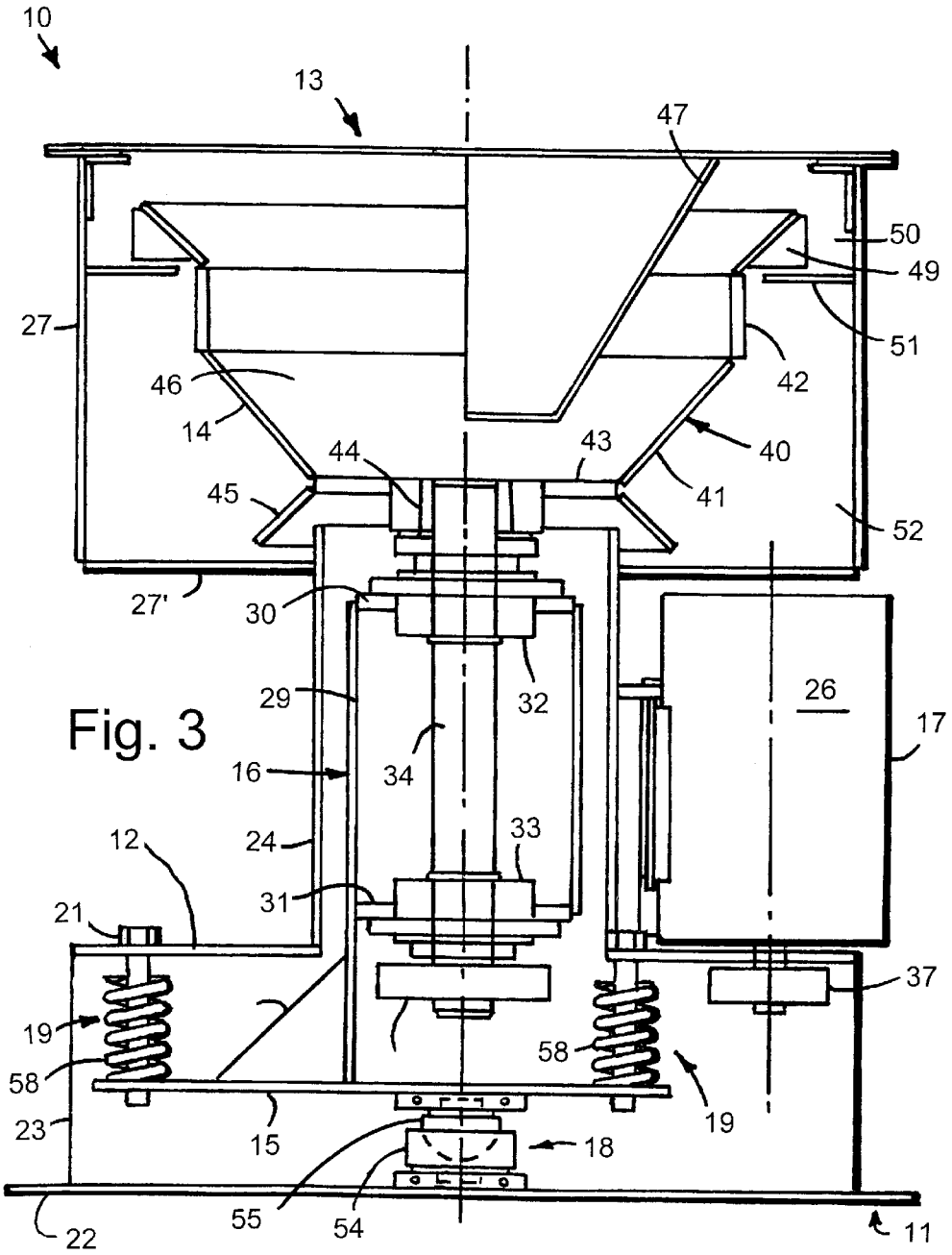
FIGS. 3 and 3A are side cross-sectional views similar to FIG. 1 but showing the lifter screws installed, FIG. 3A showing the centrifuge device lifted to disengage components of the bottom pivot mount.

A plurality of biasing devices 19 are extended between the centrifuge support plate 15 and the raised platform 12. The biasing devices 19 press against a bottom side of the raised platform 12 and against a top of the centrifuge support plate 15 to bias the centrifuge support plate 15 downwardly away from the raised platform 12 and against the mount 18. The biasing devices 19 are spaced apart at locations around the mount 18 and are adjustable so that the biasing devices 19 can be adjusted to an optimal pressure for counteracting non-axial forces and vibrations generated as the centrifuge device 13 is operated. Further, the biasing devices 19 are easily accessible due to their location, such that they can be readily and safely adjusted during operation of the centrifuge device 13, which facilitates optimizing their adjustment. Also, the area under the centrifuge support plate 15 and around the mount 18 is characteristically open and unobstructed, such that inspection, repair, and maintenance is greatly facilitated. Still further, the arrangement allows use of lifters 21 (FIGS. 3 and 4) to raise the centrifuge support plate 15 to separate the mount 18 for repair, without maintenance personnel having to work in the mess and debris around the mount 18 to disconnect the mount 18.

Base 11 (FIG. 1) includes a floor-engaging bottom plate 22 and side walls 23 that support the raised platform 12 above the bottom plate 22. The raised platform 12 includes a center hole, and a cylindrical outer tower 24 is attached to the raised platform 12 around the center hole and extends upwardly. The outer tower 24 protects the stand 16, and further provides a stationary support for the motor 26 and for the cylindrical outer wall 27 and bottom 27' of housing 28.

The stand 16 (FIG. 1) includes a cylindrical inner tower 29 that is attached to the centrifuge support plate 15 and extends upwardly within the outer tower 24. A pair of bearing support plates 30 and 31 are attached to the inner tower 29 at spaced-apart locations, and a pair of bearings 32 and 33 is operably attached to the support plates 30 and 31, respectively, for rotatably supporting a drive shaft 34. The motor 26 is electrical and is attached to an outside of the outer tower 24 by motor mounts 35. The motor 26 and the drive shaft 34 each include aligned pulleys 36 and 37, and a drive belt 38 is extended around the pulleys 36 and 37. Reinforcement braces 39 are attached at the joindure of the inner tower 29 and centrifuge support plate 15 to rigidify their connection.

The centrifuge device 13 (FIG. 1) includes a separator bowl 40 having side walls formed by a non-apertured wall section 41 and an apertured wall section 42. The separator bowl 40 further includes a bottom wall 43 connected to the drive shaft 34 by connection 44. An outwardly angled curtain 45 extends from the bottom wall 43 to deflect liquid away from the area of connection 44. More specifically, the curtain 45 directs liquid that drips down the outside of the separator bowl 40 away from the drive shaft connection 44, away from the bearings 32 and 33, and generally outside of outer tower 24. Radial blades 46 are included in the bowl 40 to circumferentially motivate liquid-laden metal chips deposited in the separator bowl 40. A conical top 47 contains the chips within the active centrifugal chamber 48 of the bowl during operation. The radial fin blades 49 motivate chips outwardly in the bowl across the apertured wall section 41 to a chip receiving area 50 located above horizontal flange 51, while the liquid passes through the apertured wall section 42 into a liquid collection area 52 below flange 51.

Mount 18 (FIG. 3) includes a socket-defining member 54 attached to the bottom plate 22 and a ball-section member 55 attached to a bottom of the centrifuge support plate 15 that is shaped to fit into the semi-spherical recess 56 of socket-defining member 54. The mount 18 defines a pivot permitting the centrifuge support plate 15 to pivot about non-vertical axes. The pivotal support provided by mount 18 is desirable given the vibrations and non-uniform forces generated by the spinning centrifuge device 13. It is specifically contemplated that different mounts can be provided in place of mount 18. For example, it is known to provide a resilient rubber member that is sufficiently strong to support the centrifuge device 13, but that is also flexible enough to allow non-axial movement. The resilient member can also act to dampen vibrations generated by the centrifuge device 13.

Figure 2:
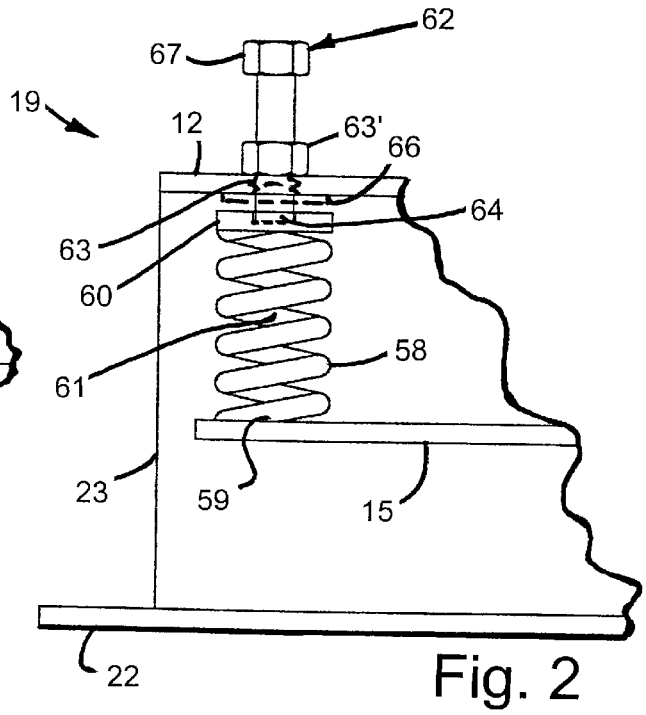
FIG. 2 is an enlarged view of the circled area II in FIG. 1.

The biasing devices 19 (FIG. 2) are located below the raised platform 12 and above the centrifuge support plate 15 and are spaced around the mount 18. The number and/or spacing of the biasing devices 19 can be varied based on design criteria and functional requirements. The biasing devices 19 can be constructed from a number of different means for providing an adjustable biasing force. The illustrated biasing devices 19 each include a spring assembly (FIG. 2) comprising a coil spring 58, a bottom locator 59 configured to locate a bottom of the coil spring 58 on the centrifuge support plate 15, and a top locator 60 for engaging a top of the coil spring. A tubular vertical spring guide can be positioned in spring 58 between the locators 59 and 60, if desired, to guide the movement of spring 58. In such event, the vertical spring guide is constructed to control lateral flexure of the spring 58, but permits linear compression. A tension adjustment screw 62 extends through a threaded hole 63 in the raised platform 12 and includes threads that threadably engage the threaded hole 63. A locking nut 63' is located on screw 62 for locking the screw 62 in an adjusted position. An end 64 (FIG. 2) of the adjustment screw 62 engages a recess 65 in the top locator 60. Spring 58 can be compressed to increase the stress therein by rotating the adjustment screw 62 to extend the adjustment screws 62 downwardly. A nut 66 can be welded to raised platform 12, if desired, to increase the stability of the biasing devices 19 by increasing the number of threads that engage the adjustment screw 62 where a given design requires such added support. Also, the adjustment screw 62 can be held in an adjusted position by various means, such as through use of a locking nut, set screws, locking materials added to the threads, and the like. Notably, the upper end and head 67 of the adjustment screw 62 extends above the raised platform 12 to a location that is readily accessible for adjusting a tension of the biasing devices 19. The location of the upper end and head 67 characteristically does not interfere with inspection and/or repair of the mount 18, and further it is located in a relatively clean area on the centrifuge chip separator 10, which further facilitates repair and maintenance.

Figure 3A:
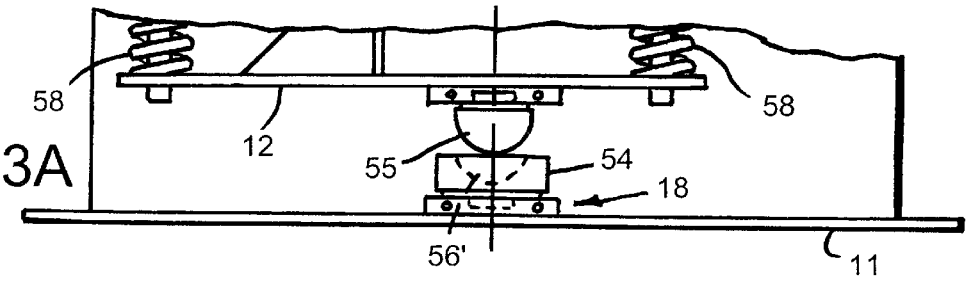

Lifters 21 (FIGS. 3 and 3A) can be used to facilitate replacement and/or repair of the mounts 18. It is contemplated that lifters 21 can be any of a number of different designs. The illustrated lifters 21 are screws having a smaller diameter and longer shaft than the adjustment screws 62. To use the lifters 21, the adjustment screws 62 and top locator 60 are removed and lifters 21 are inserted in their place. The shaft 21' of the lifters 21 extends through the center of the spring 58 and threadably into a threaded hole 69 in the bottom locator 60 and/or into a threaded hole in the centrifuge support plate 15. Due to the smaller diameter of the lifter 21, it does not threadably engage the threaded hole 63 in the raised platform 12, but instead passes through it without frictionally engaging same. For example, the tension adjustment screw 62 can be ¾ inch in diameter, while the lifter screw 21 is ½ inch in diameter. As the lifters 21 are rotated, the centrifuge support plate 15 is forcibly lifted toward the raised platform 12, causing the ball-section member 55 (FIG. 3) to vertically disengage from the socket-defining member 54. Once the ball section member 55 is fully unseated from the socket-defining member 54, one or the other (or both) of the members 54 and 55 can be inspected, removed, or repaired.

Figure 5:
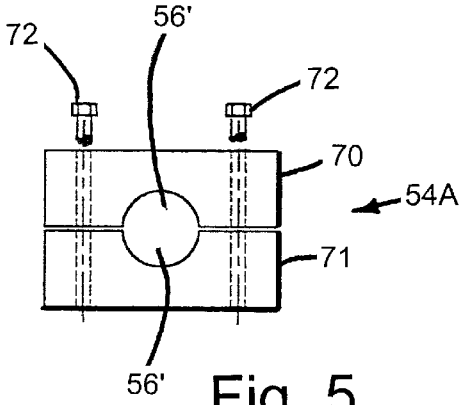
FIG. 5 is an exploded plan view of a modified socket-defining member.

A modified socket-defining member 54A (FIG. 5) is provided that includes two halves 70 and 71 bolted together with transverse bolts 72, each half 70 and 71 including recess halves 56'. The bolts 72 extend through one half 70 and thread into the other half 71 to hold the two halves together. By unscrewing the bolts 72, the halves 70 and 71 can be disassembled, allowing the ball-section member 55 to be removed without having to raise the ball-section member 55 far enough to clear the socket-defining member 54. Notably, at least one of the halves 70 and 71 is anchored to the bottom plate 22. The anchoring of the socket-defining member 54A can be accomplished by locator means that pass through the socket-defining member 54A, or that abut sides of the socket-defining member 54A.

As noted above, the above centrifuge chip separator 10 advantageously facilitates repair and maintenance. Notably, the area in, around, and under the centrifuge chip separator 10 is characteristically left open and generally unobstructed, such that it is much easier to maintain a clean machine and clean environment around the machine. To replace and/or repair the mount 18, the adjustment screws 62 and top locator 60 are removed and temporarily replaced with the screw-type lifters 21. The lifters 21 are threaded into the threaded holes in the centrifuge support plate 15, lifting the centrifuge support plate 15 (and the centrifuge device 13). The centrifuge support plate 15 is raised sufficiently to raise the ball-section member 55 above the socket-defining member 54. Where a modified split socket-defining member 54A is used, the centrifuge support plate 15 is lifted only enough to take the pressure off of the socket-defining member 54A, and then the socket-defining member halves 70 and 71 are unbolted and separated. The defective or worn components are replaced or repaired, and the process is reversed to reassemble the mount 18. After the adjustment screws 62 are installed, they are tightened to provide a pretension on the springs 58. The pretension in the springs 58 is adjusted during operation of the centrifuge device 13 to an optimal force counteracting the effects of the vibrations and non-uniform forces generated by the spinning centrifuge device 13.

In the foregoing description, it will be readily appreciated by persons skilled in the art that modifications may be made to the invention without departing from the concepts disclosed herein. Such modifications are to be considered as included in the following claims, unless these claims by their language expressly state otherwise.

The invention claimed is:

1. A centrifugal chip separator comprising:

a base having a bottom and a raised platform;

a centrifuge device adapted to separate liquid from liquid-laden metal scrap by centrifugal force, the centrifuge device including a centrifuge support plate located below the raised platform, but above the bottom;

a mount operably supporting the centrifuge support plate on the bottom for limited non-axial movement as the centrifuge device is operated; and a plurality of biasing devices extending between the centrifuge support plate and the raised platform that press against the raised platform to bias the centrifuge support plate downwardly away from the raised platform and against the mount, the biasing devices being spaced apart at locations around the mount and being adjustable so that the biasing devices can be adjusted to an optimal pressure for counteracting non-axial forces and vibrations generated as the centrifuge device is operated, the biasing devices including springs constructed to bias the centrifuge support plate downwardly from the raised platform and against the mount.

2. The centrifugal chip separator defined in claim 1 wherein the base has an outer housing that includes the raised platform, and wherein heads of the biasing devices extend outside of the housing to locations where the heads are readily accessible for adjustment, even while the centrifuge device continues to operate.

3. The centrifugal chip separator defined in claim 2 wherein the biasing devices each include an adjustment screw threaded into the raised platform, the adjustment screws each extending into engagement with the centrifuge support plate to bias the centrifuge support plate downwardly.

4. The centrifugal chip separator defined in claim 3 wherein the mount includes a ball-section member and a mating socket-defining member defining a socket for operably receiving the ball-section member.

5. The centrifugal chip separator defined in claim 4 wherein the socket-defining member includes a pair of mating parts forming opposing halves of the socket, which mating parts can be separated.

6. The centrifugal chip separator defined in claim 1 wherein the biasing devices each include an adjustment screw threaded into the raised platform, the adjustment screws each extending into engagement with the centrifuge support plate to bias the centrifuge support plate downwardly.

7. The centrifugal chip separator defined in claim 1 wherein the mount includes a ball-section member and a mating socket-defining member defining a socket for operably receiving the ball-section member.

8. The centrifugal chip separator defined in claim 7 wherein the socket-defining member includes a pair of mating parts forming opposing halves of the socket, which mating parts can be separated.

9. A centrifugal chip separator comprising:

a base having a bottom and a raised platform, wherein the base has an outer housing that includes the raised platform;

a centrifuge device adapted to separate liquid from liquid-laden metal scrap by centrifugal force, the centrifuge device including a centrifuge support plate located below the raised platform, but above the bottom;

a mount operably supporting the centrifuge support plate on the bottom for limited non-axial movement as the centrifuge device is operated, and wherein the mount includes a ball-section member and a mating socket-defining member defining a socket for operably receiving the ball-section member;

a plurality of biasing devices, each including an adjustment screw threaded into the raised platform, the adjustment screws each extending into engagement with the centrifuge support plate to bias the centrifuge support plate downwardly, and extending between the centrifuge support plate and the raised platform, the biasing device pressing against the raised platform to bias the centrifuge support plate downwardly away from the raised platform and against the mount, the biasing devices being spaced apart at locations around the mount and being adjustable so that the biasing devices can be adjusted to an optimal pressure for counteracting non-axial forces and vibrations generated as the centrifuge device is operated, and wherein heads of the biasing devices extend outside of the housing to locations where the heads are readily accessible for adjustment, even while the centrifuge device continues to operate; and wherein the biasing devices include springs constructed to bias the centrifuge support plate downwardly from the raised platform and against the mount.

10. The centrifugal chip separator defined in claim 1, including a plurality of lifters that extend between the centrifuge support plate and the raised platform, and that are constructed to lift the centrifuge support plate off of the mount for repair and maintenance.

11. The centrifugal chip separator defined in claim 10 wherein the lifters are bolts constructed to thread into the centrifuge support plate and constructed to lift the centrifuge support plate when operated.

12. The centrifugal chip separator defined in claim 11 wherein the biasing devices include bolts that threadably engage threaded holes in the raised platform, and wherein the lifters extend through the threaded holes and have threaded shafts, but wherein the threaded shafts of the lifters have a smaller diameter, such that the threaded shafts do not engage the raised platform, but instead threadably engage second threads on the centrifuge support plate.

13. The centrifugal chip separator defined in claim 10 wherein the base has an outer housing, and wherein heads of the biasing device extend outside of the housing for easy access and adjustment, even while the centrifuge device is operated.

14. The centrifugal chip separator defined in claim 13 wherein the biasing device includes screws threaded to the raised platform and operably engaging the centrifuge support plate in a manner biasing the centrifuge support plate downwardly.

15. The centrifugal chip separator defined in claim 10 wherein the mount includes a ball section and a socket configured to operably receive the ball section.

16. The centrifugal chip separator defined in claim 15 wherein the mount includes socket-defining member, the socket-defining member comprising a pair of mating parts each having opposing halves of the socket formed therein.

17. The centrifugal chip separator defined in claim 10 wherein the biasing devices each include a spring that engages the centrifuge support plate to bias the centrifuge support plate downwardly from the raised platform.

18. A centrifugal chip separator comprising:

a base;

a centrifuge device adapted to separate liquid from liquid-laden metal scrap by centrifugal force, the centrifuge device including a centrifuge support plate;

a mount operably supporting the centrifuge support plate on the base for limited non-axial movement as the centrifuge device is operated, the mount including a socket-defining member, and further including a ball-section member operably engaging the socket-defining member, the socket-defining member comprising a pair of vertically-split mating socket sections constructed to be mated horizontally together to form a socket for operably vertically receiving the ball-section member and constructed to be separated to facilitate removing the ball-section member from a lateral direction for repair and maintenance; and a plurality of biasing devices located between the centrifuge support plate and the base, the biasing devices being spaced apart at locations around the mount and being adjustable, so that the biasing devices can be adjusted to an optimal pressure for counteracting non-uniform forces and vibrations generated as the centrifuge device is operated.

19. The centrifugal chip separator defined in claim 18 wherein an area under the centrifuge support plate and around the mount is characteristically open to provide access to the mount for repair and maintenance.

20. A centrifugal chip separator comprising:

a base having a bottom and a raised platform;

a centrifuge device adapted to separate liquid from liquid-laden metal scrap by centrifugal force, the centrifuge device including a centrifuge support plate located below the raised platform, but above the bottom, the centrifuge support plate having an upper surface;

a mount operably supporting the centrifuge support plate on the bottom for limited non-axial movement as the centrifuge device is operated; and plurality of biasing devices engaging the upper surface and extending between the centrifuge support plate and the raised platform that press against the raised platform to bias the centrifuge support plate downwardly away from the raised platform and against the mount, the biasing devices being spaced apart at locations around the mount and being adjustable so that the biasing devices can be adjusted to an optimal pressure for counteracting non-axial forces and vibrations generated as the centrifuge device is operated.

21. The centrifugal chip separator defined in claim 20, wherein the centrifuge device includes a separator bowl with internal radial blades therein, the bowl and blades being characteristically heavy duty and constructed to be durable and resistant to damage and excessive wear from abrasive metal scrap.

* * * * *